United States Patent [19]

Innes

[11] Patent Number: 4,675,230

[45] Date of Patent: Jun. 23, 1987

[54] APPARATUS AND METHOD FOR COATING ELONGATED STRIP ARTICLES

[75] Inventor: Robert A. Innes, Ontario, Canada

[73] Assignee: Alcan International Limited, Montreal, Canada

[21] Appl. No.: 796,920

[22] Filed: Nov. 12, 1985

[51] Int. Cl.[4] ..... B05D 3/12; B05D 5/00; B05C 11/02; B05C 3/02

[52] U.S. Cl. ..... 427/280; 118/107; 118/411; 118/416; 427/286; 427/355; 427/369

[58] Field of Search ..... 118/411, 419, 107, 416; 427/286, 280, 369, 355

[56] References Cited

U.S. PATENT DOCUMENTS

| | | | |
|---|---|---|---|
| 4,143,187 | 3/1979 | Pilgrim et al. | 427/358 |
| 4,356,216 | 10/1982 | Gailey et al. | 118/411 |
| 4,356,217 | 10/1982 | Wollam et al. | 427/286 |
| 4,387,123 | 6/1983 | Wollam et al. | 118/411 X |

*Primary Examiner*—Michael R. Lusignan

*Attorney, Agent, or Firm*—Cooper, Dunham, Griffin & Moran

[57] ABSTRACT

Apparatus and procedure for applying a paint or like coating to an elongated strip article using a coating head having an open-sided slot to which coating material is supplied under pressure, and a support such as a roll around which the strip is advanced past the head for receiving from the slot a layer of paint metered between the head and the strip, wherein a load is continuously exerted on the head during operation for urging the head against the applied paint layer on the strip so as to maintain a uniform metering gap between the head and the coated strip surface. The load may be exerted by devices such as air cylinders acting on the head and capable of adjustment to vary the magnitude of the load for different coating operations.

7 Claims, 3 Drawing Figures

APPARATUS AND METHOD FOR COATING ELONGATED STRIP ARTICLES

BACKGROUND OF THE INVENTION

This invention relates to the coating of major surfaces of elongated strip articles, such as sheet metal strip and the like. More particularly, it relates to apparatus and methods for continuously applying, to a strip major surface, a layer of paint or other liquid coating material.

By way of specific illustration, detailed reference will be made herein to the coating of sheet metal in greatly elongated strip form, as used for making siding panels for cladding exterior building walls, it being understood, however, that the invention in its broader aspects embraces the coating of other types of articles and surfaces as well.

In the production of siding panels from metal strip, at least one major surface of the strip is first given a protective and decorative coating of paint, and the strip is thereafter formed and cut into individual panels. As described, for example, in U.S. Pat. Nos. 4,356,217 and 4,411,218, the disclosures of which are incorporated herein by this reference, it is known to perform strip coating on a continuous line using a rigid coating head that defines an elongated open-sided slot to which liquid coating material (e.g. paint) is continuously supplied under pressure. The strip is continuously advanced longitudinally past the open side of the slot in a direction transverse to the long dimension of the slot while a major surface of the advancing article is maintained in facing proximate relation to the slot such that liquid coating material from the slot is deposited in a layer on the advancing strip surface. The thickness of this layer is dependent on the spacing between the strip surface and the coating head downstream of the slot; as shown in the aforementioned patents, the head is provided with an extended surface immediately adjacent the open side of the slot, and this surface defines (with the strip surface being coated) a metering orifice that determines the thickness of paint coating carried on the strip away from the slot. Typically, the strip advancing past the slot is backed up by an axially fixed roll.

The aforementioned patents particularly describe coating apparatus and procedures wherein the slot has the form of a trench and the applied paint or like coating has a striated or variegated appearance effected by concurrent supply of at least two colors of paint to the slot. The described apparatus and procedures, however, may also be employed to apply a single-color layer of paint.

In coating operations of this general type, desired uniformity of coating thickness requires maintenance of a metering orifice of invariant aperture; i.e., the spacing between the coating head and the coated strip surface, downstream of the slot, must remain constant despite variations in thickness of the strip being coated. Heretofore, it has been customary to control the thickness of coating application by mechanically fixing the position of the coating head surface relative to the strip surface being coated. In order to accommodate variations in strip thickness, in these known systems, the entire coating assembly has been mounted on small wheels that ride on the strip ahead of the locality of coating application (i.e., ahead of the slot). The use of such wheels has given rise to problems, especially in production of coatings of uniform single color. It is found that the wheels make visible marks that show through a single-color coating applied over a primer coating, although these marks are masked when the applied coating has a variegated or striated pattern; since use of a primer coating is generally desirable, and since the presence of such marks detracts from the appearance and acceptability of the coated product, the use of the wheels to maintain uniform spacing is disadvantageous for monochromatic coating applications. Also, in an experimental run on a strip-coating line employing the described wheels, bars of varying thickness across the width of the sheet have been observed; these bars are believed to have been caused by the wheels, either through vibration or as a result of the fact that the wheels must be spaced some distance ahead of the slot. Again, the creation of such bars detracts from desired coating uniformity.

SUMMARY OF THE INVENTION

The present invention, in a first aspect, broadly contemplates the provision of new and improved stripcoating apparatus of the general type comprising a rigid coating head defining an elongated, open-sided slot and having an extended surface immediately adjacent the open side of the slot; means for supplying liquid coating material under pressure to the slot; and means for longitudinally advancing a strip article successively past the slot open side and the extended surface of the head in a direction transverse to the long dimension of the slot while maintaining a major surface of the article in facing proximate relation to the slot, so as to constitute a moving wall substantially closing the slot open side, such that during operation with the article advancing past the slot and liquid coating material supplied to the slot, the last-mentioned article major surface drags a layer of the coating material from the slot. The apparatus of the invention includes means for supporting the head while permitting translational movement of the head relative to the supporting means in a direction perpendicular to the long dimension of the slot, and in this apparatus, the strip-advancing means supports the strip, opposite the slot, at a fixed distance from the head-supporting means. As a particular feature of the invention, the apparatus further includes means, acting between the head-supporting means and the head, for continuously exerting a load on the head to urge the head toward the last-mentioned article major surface such that, during operation as aforesaid, the head is pressed by the loadexerting means against the deposited layer of coating material to maintain the coating layer at a predetermined constant thickness while that layer alone holds the head entirely away from contact with the lastmentioned article major surface.

Advantageously, the load-exerting means is adjustable to vary the magnitude of the load, e.g. in accordance with such factors as coating material viscosity, strip speed, and desired coating thickness. In illustrative and currently preferred embodiments, the load-exerting means comprises at least one air cylinder, and most preferably a plurality of air cylinders positioned to act on the head at locations spaced along the length of the slot. Also, in convenient or preferred embodiments, the strip-advancing means includes a roll having an axis parallel to the long dimension of the slot and fixed in relation to the headsupporting means, the roll further having a cylindrical surface positioned closely adjacent the slot open side; and the extended surface of the head is shaped and positioned to approach progressively nearer to the cylindrical roll surface in the direction of advance of the strip article.

In a second aspect, the invention contemplates the provision of a method of coating a major surface of an elongated strip article, comprising the steps of supplying liquid coating material under pressure to an elongated, open-sided slot defined in a rigid coating head having an extended surface immediately adjacent the open side of the slot, the head being supported for translational movement in a direction perpendicular to the long dimension of the slot, while continuously longitudinally advancing a strip article successively past the slot open side and the extended surface of the head in a direction transverse to the long dimension of the slot with a major surface of the article maintained in facing proximate relation to the slot so as to constitute a moving wall substantially closing the slot open side, such that the last-mentioned article major surface drags a layer of the coating material from the slot, and while continuously exerting a load on the head to urge the head toward the last-mentioned article major surface such that the head is pressed by the load-exerting means against the deposited layer of coating material to maintain the coating layer at a predetermined constant thickness while that layer alone holds the head entirely away from contact with the lastmentioned article major surface.

In the apparatus and method of the invention, the maintenance of a load on the coating head for control of coating layer thickness enables the head to conform positionally to variations in strip thickness (for maintaining a constant metering orifice aperture) without resort to wheels riding on the sheet; hence the problems associated with such wheels are avoided. In addition, the provision of the defined load-exerting means or step improves accuracy and ease of set-up.

Further features and advantages of the invention will be apparent from the detailed description hereinbelow set forth, together with the accompanying drawings.

DETAILED DESCRIPTION

Figure 1:
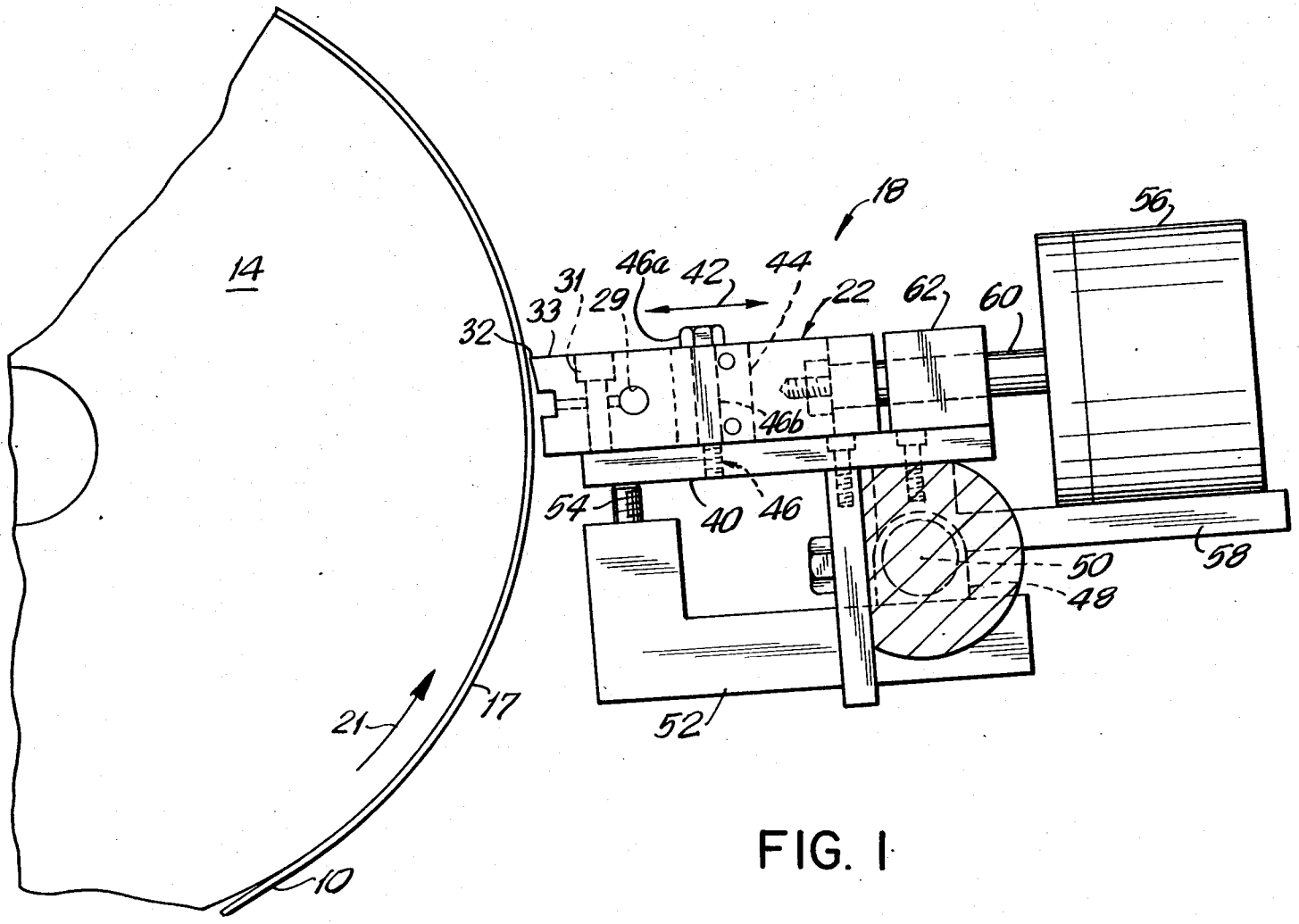
FIG. 1 is a simplified, schematic elevational view of coating apparatus embodying the present invention in a particular form.

The invention is illustrated in the drawings as embodied in procedures and apparatus for coating sheet metal strip to establish a uniform, single-color paint layer on a major surface of the strip before the strip is formed and cut to produce siding panels. Such strip is typically an elongated, flat sheet metal article (having a length corresponding to the combined lengths of a substantial number of panels, and a width corresponding to the width of one or more panels), of a gauge suitable for siding panels, and is usually coiled for ease of handling.

Figure 2:
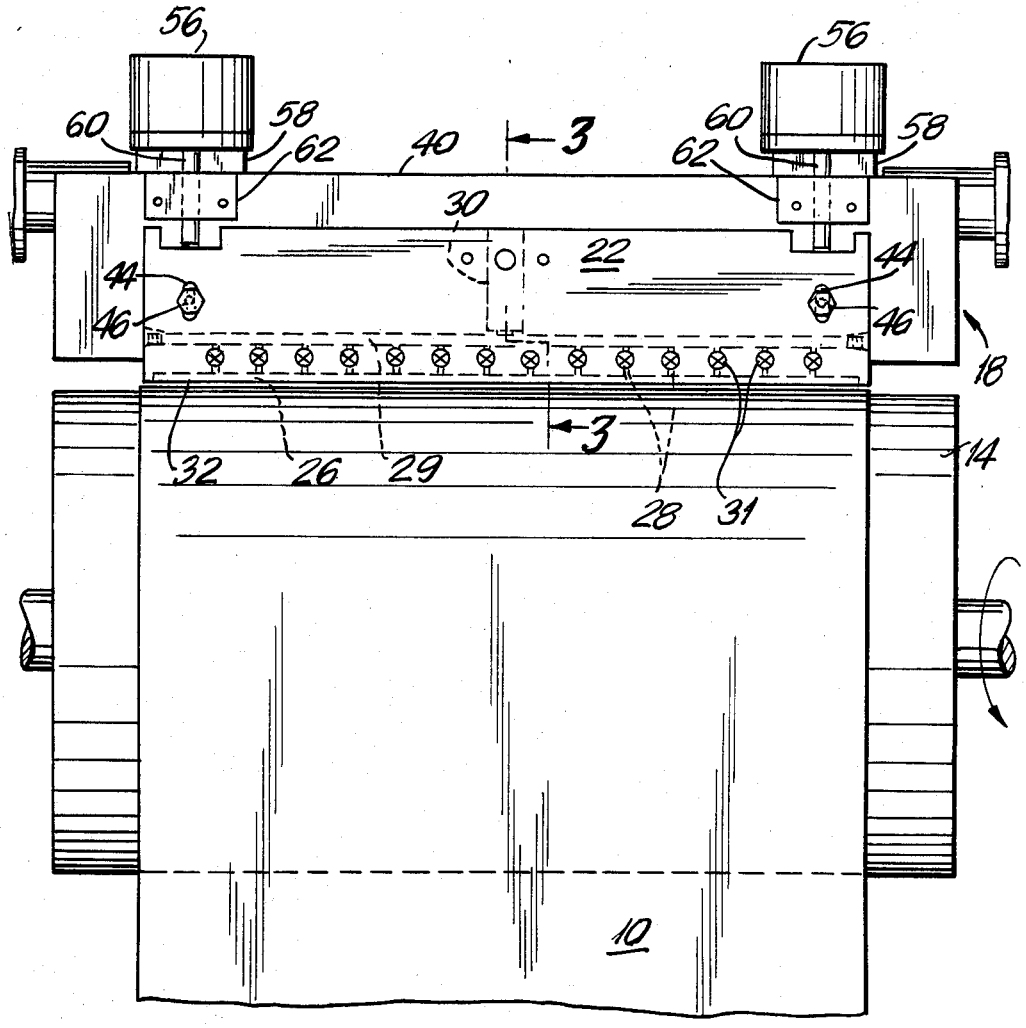
FIG. 2 is a plan view (to a smaller scale) of the apparatus of FIG. 1.

In the coating apparatus schematically shown in FIGS. 1–2, metal strip 10 to be coated is continuously advanced (by suitable and e.g. conventional strip-advancing means) longitudinally parallel to its long dimension from a coil (not shown) around a back-up roll 14 rotatably supported (by structure not shown) in an axially fixed position. At a locality at which the strip is held againt the back-up roll, paint is applied to the outwardly facing major surface 17 of the strip from a coating device 18, to establish on the strip surface 17 a continuous layer or coating of the paint. It will be understood that the major surface 17 of the strip 10 may bear a previously applied undercoat or primer coat of paint, and the opposite surface of the strip may also be precoated. Beyond the roll 14, the strip is passed through an oven to cure the coating and thereafter coiled again, e.g. on a driven rewind reel (not shown) which, in such case, constitutes the means for advancing the strip through the coating line; within the oven (which is also not shown) the advancing strip is in catenary suspension, and the weight of the suspended portion holds the strip against the back-up roll 14. The direction of strip advance through the coating line is indicated by arrow 21.

The coating device 18 includes a rigid coating head comprising a metal block 22 having a flat or concavely curved surface 24 spaced from the roll surface to define therewith a gap through which the advancing strip 10 passes. As best seen in FIG. 2, the head 22 extends over the entire width of the strip at a locality, in the path of strip advance, at which the strip is held against the surface of the roll 14.

Figure 3:
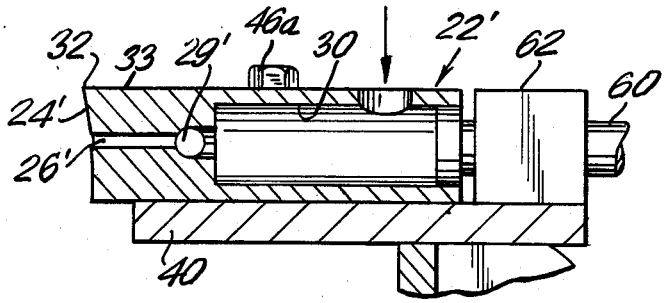
FIG. 3 is an enlarged fragmentary sectional view of a modified form of coating head, taken as along the line 3—3 of FIG. 2.

Formed in the head 22 is an elongated slot 26 which opens outwardly through the surface 24 of the head but is otherwise fully enclosed by the head except for paint-delivery apertures 28. This slot, in the embodiment shown in FIGS. 1–3, is an axially rectilinear cavity in the form of a trench having flat closed ends, and a uniform cross-section throughout. It is oriented with its long dimension transverse to the direction of advance of the strip 10; very preferably, the long dimension of the slot is perpendicular to the direction of strip advance and parallel to the axis of rotation of the roll 14.

Extending within the head 22, in axially parallel relation to the slot, is an elongated enclosed manifold chamber 29 for containing liquid coating material (paint) under pressure. Paint is supplied to the manifold through one or more feed passages 30 formed in the head 22, and is conducted therefrom to the slot 26 through the aforementioned apertures 28, which are individually controlled by valves 31. In operation, paint is continuously delivered from a container (not shown) under pressure (by any suitable, e.g. conventional, means, not shown, typically employing hydrostatic pressure or a pump to provide the required pressurized feed) through at least one of the passages 30 to the manifold at a rate sufficient to keep the manifold entirely filled and to force the paint therefrom under pressure through the apertures 28 to the slot 26, so that the slot as well is continuously entirely filled with paint under pressure. For uniform monochormatic coating, a single color of paint is supplied to the manifold, and all the valves 31 are maintained at a constant setting (some at least being open); however, the head 22 is also capable of use to produce a striated or variegated coating of two or more colors, by appropriate supply of such plural colors and periodic opening and closing of different valves 31 to vary the pattern as coating proceeds. In a broad sense, the apparatus and method of the invention are equally applicable to the production of single-color and multicolor (patterned) coatings.

In the modified head structure 22' shown in FIG. 3, the apertures 28 and valves 31 are omitted, and the slot (designated 26') opens rearwardly along its full length directly into the manifold 29'. This slot 26' is narrower (in the direction of strip advance) than slot 26 of FIGS. 1 and 2, being defined by parallel plane walls extending from surface 24' to manifold 29', and is, again, closed at its ends (not shown in FIG. 3). By way of example, the width of slot 26' in the direction of strip advance (viz. the width of the slot opening through surface 24') may be 0.04 inch, and the length of the slot (from surface 24' to manifold 29') may be ¼ inch. This head is suitable for use in accordance with the invention to apply a single-color paint coating to a strip surface, the paint passing from manifold 29' to the slot opening in surface 24' along the entire length of the slot. Except for the differences just set forth, the head 22' of FIG. 3 may be considered essentially the same as the head 22 of FIGS. 1 and 2, and the following description of the invention, though particularly addressed to the embodiment of FIGS. 1 and 2, is equally applicable to a head of the form shown in FIG. 3.

As will be understood from the foregoing description, the slot 26 has an open long side (viz. the opening of the slot through surface 24) which extends, transversely of the path of strip advance, from end to end of the slot. The location and length of the open slot side determine the position and width, on the advancing strip, of the coating to be applied. That is to say, the open long side of the slot has a length less than or equal to the strip width, and is disposed for register with that portion of the width of the strip surface 17 which is to be coated. The back-up roll 14 supports the strip surface 17 in proximate facing relation to the open side of the slot as the strip passes the slot, so that the surface 17 constitutes a moving wall that closes the open slot side and enables the slot to be maintained filled with paint.

The described arrangement of slot and strip results in deposit of paint from the slot onto the strip surface 17 over the full width of the portion of the surface 17 that coincides with the open side of the slot, i.e. when the slot is filled with liquid paint delivered through the aperture 28. The deposited paint is carried out of the slot as a coating on the advancing strip surface, past the outlet edge of the open side of the slot and through the gap between the surface 24 and the roll 14 beyond the slot. The downstream edge 32 of surface 24, shown as a sharp discontinuity between the surface 24 and the upper end 33 of the head 22, extends across the width of the deposited paint coating on the strip surface 17 and, together with the surface 17, defines a metering orifice that determines the thickness of paint coating carried on the strip away from the head; as will be understood, the spacing between the surface 17 and edge 32 should be such as to constitute a gap providing a desired wet thickness of paint coating on the surface 17, this wet thickness being less than the aperture of the gap. The coating strip surface emerges from beneath the head past edge 32. Preferably, the plane of end 33 forms an angle (opening upwardly toward the direction of strip advance) of at least about 90° with the plane tangent to the strip surface 17 at edge 32, for assured avoidance of pick-up of paint from the emerging strip onto the surface 33; in FIG. 1, this angle is shown as greater than 90°.

As illustrated in FIG. 1, the head 22 is preferably so disposed that its slot, facing back-up roll 14, lies in a near-horizontal plane containing the axis of rotation of the back-up roll, and the coating line is so arranged that the strip is held against the back-up roll at this locality, which is thus the locality at which paint is applied to the strip. It will be understood that in continuous coating of strip, successive lengths of strip are usually joined together (spliced) endwise at a transverse seam which is thicker than the strip gauge; when this seam passs between the head 22 and roll 14, the head must be temporarily moved away from the roll sufficiently to accommodate the thickness of the seam. The disposition of the head shown in FIG. 1 facilitates this operation because paint in the slot, when released by movement of the head away from the strip, falls clear of the strip surface rather than falling on and fouling the strip surface as would occur if the head were located above the strip.

The apparatus of the invention, in its illustrated embodiment, includes a deck 40 having a flat upper surface on which the head 22 rests, the head being thus supported for translational (sliding) movement relative to the deck in a generally horizontal direction (arrow 42) perpendicular to the long dimension of the slot 26, i.e. toward and away from the roll 14. As best seen in FIGS. 1 and 2, a pair of vertically opening slots 44, elongated horizontally in the direction of arrow 42, are formed in the body of the head 22 rearwardly of the manifold 29 at locations spaced along the length of the head; a pair of bolts 46 respectively extend through these slots and are threaded in the deck. The bolt heads **46*a* overlie the top surface of the coating head 22 for preventing vertical movement of the head 22 relative to the deck, while interference between the bolt shanks 46*b* and the side walls of the slots 44 prevents lateral movement of the head 22 relative to the deck, but the elongation of the slots permits the head 22 to move in the direction of arrow 42** through the full range of operative head positions.

The deck 40 is mounted on a fixed frame 48 for pivotal movement about a horizontal axis 50, so as to enable the head 22, with the deck, to be swung upwardly (e.g. by suitable pneumatic means, not shown) from the position illustrated in FIG. 1 to a position removed from the path of strip advance. An arm 52, fixedly secured to the frame 48 and underlying the deck 40, carries a screw 54 that projects upwardly from the arm and bears against the lower surface of the deck 40, to enable adjustment of the angular orientation of the head 22 in its operative position.

The frame 48 is fixed in position relative to the axis of the roll 14, both the frame and the roll being (for example) fixedly mounted in a common support structure (not shown). Thus, the axis 50 is fixed in position relative to the axis of the roll 14; and when the deck 40 is in the operative position shown in FIG. 1, with the screw 54 set to provide a desired angular orientation, the roll 14 supports the advancing strip 10, opposite the slot 26, at a fixed distance from the deck 40.

In accordance with the invention, and as a particular feature thereof, the apparatus further includes means acting between the deck 40 and the head 22 for continuously exerting a load on the head to urge the head toward the facing major surface of the strip 10. This load-exerting means, in the illustrated embodiment of the apparatus, comprises a pair of air cylinders 56 fixedly secured to the deck 40 rearwardly of the head 22. As shown, the cylinders 56 are secured to rearwardly projecting ledge portions 58 of the deck, respectively adjacent opposite extremities of the long dimension of the slot 26. Each air cylinder includes a piston having a shaft 60 which extends forwardly from the cylinder, and through a guide block 62 mounted on the deck 40, to bear against a rear surface of the head 22. Thus, actuation of the air cylinders (which may be of a generally conventional character and accordingly need not be described in detail) causes the piston shafts 60 to push the head 22 toward the surface 17 of strip 10, i.e. toward the roll 14. As best seen in FIG. 2, the localities of engagement of the two air cylinder piston shafts 50 with the head 22 are spaced equidistantly from the extremities of the slot 26; in the case of a very long head, a greater number of air cylinders may be employed, and in such case, these additional cylinders may be arranged to act on the head at locations spaced along the slot long dimension.

The operation of the described apparatus, and the performance of the method of the invention therewith, may now be readily explained. With a strip 10 (e.g. having a primer coating on surface 17) extending around the roll 14 as shown in FIG. 1, and with the deck 40 in the operative position also shown in FIG. 1, the cylinders 56 are actuated to exert on the head 22 a predetermined load urging the head against the strip surface 17. This load initially brings the edge 32 of the head against the primer-coated strip surface. As advance of the strip commences, and paint is supplied under elevated pressure to the manifold and thence to the slot 26 of the head 22, the fluid pressure of paint forced into the space between the strip surface and the head surface 24, in the direction of strip advance, causes the head 22 to back off from contact with the strip surface. Thereby, a metering orifice is defined between the head edge 32 and the strip surface 17, the size (aperture) of this orifice being determined (for paint of a given viscosity) by the magnitude of the load exerted by the cylinders 56.

It will be appreciated that the rate of paint flow through the slot 26, and the fluid pressure of paint acting on the surface 24 in the gap beyond the slot, are primarily determined by drag forces of the strip rather than by the supply pressure of paint in the manifold. Thus, a small positive supply pressure (e.g. 5 p.s.i.) is typically sufficient, and the aforementioned drag forces, as the strip surface moves past the slot opening, create a much higher fluid pressure between the strip surface 17 and head surface 24.

As advance of the strip 10 continues, with continuing supply of paint under pressure to the slot 26, a uniform layer of paint is deposited on the strip surface. Throughout the operation, the cylinders 56 continuously maintain a load on the head 22, urging the head toward the strip surface being coated, and this load serves to maintain the aperture of the aforementioned metering orifice constant, regardless of local variations in strip thickness. In effect, the head surface 24 floats on the layer of paint being applied, and is maintained (by that layer alone) entirely away from contact with the strip surface while coating proceeds. The invariant aperture of the metering orifice, resulting from the described load on the head, produces a paint coating of uniform thickness.

As will be appreciated, in the described coating operation, force is generated when the gap between the strip surface and the head surface 24 converges. The force generated depends on paint viscosity, strip speed, width of the surface 24 downstream of the slot, and, to a lesser extent, on the angle of convergence, in a manner consistent with principles of lubrication theory. The load to be exerted on the head 22 by the cylinders 56 in any particular operation is determined by the viscosity of the paint being applied, strip speed, and the desired thickness of the coating; thus, at the outset of a given coating operation, the cylinders 56 are adjusted to provide the particular load required for that specific operation.

For optimum performance, the configuration and dimensions of the head surface 24 are also selected with reference to the factors of viscosity and desired coating thickness. Stated in general, application of a relatively thin film or layer of a high viscosity coating is best performed with a head in which the dimension of surface 24 between the slot and edge 32 is narrow, while for application of relatively thick films of low viscosity coatings, a relatively wide surface 24 is preferred. Heads with a dimension of surface 24 (between the slot and edge 32) of 1 mm to 19 mm have been found suitable. It is important that the head 22 provide an extended surface 24 (as distinguished from a sharp edge) on the outlet or downstream side of the slot 26, in order to achieve the above-described floating action, i.e. in order that the head, under load, will ride on the applied liquid coating layer and be held by that layer away from contact with the subjacent strip surface.

It is convenient to provide the head with two differently dimensioned portions of surface 24 respectively disposed on opposite sides of the slot 26, to enable the same head to be employed for application of different coatings (as to which different downstream dimensions of surface 24 are desired) by simply inverting the head in the apparatus.

As indicated in FIG. 1, the gap defined between the surface 24 and the strip surface being coated, beyond the slot 26, should be convergent in the direction of strip advance; i.e., the surface 24, in its extent between the slot and the edge 32, should be shaped and positioned to approach progressively nearer to the cylindrical surface of the roll 14 in the direction of advance of the strip 10. It has been found that regardless of the width of surface 24, the best results are obtained in the present coating method when the difference in strip-head clearance between the outlet edge of the slot 26 and the edge 32 is in the range of about 5–150 microns, and preferably about 10–75 microns. This preferred arrangement necessitates that the surface 24 be curved to conform to the curvature of roll 14 when the surface 24 is of large width (dimension between the slot and edge 32).

While the air cylinders illustrated in the drawings and described above represent a currently preferred means for exerting a continuous (yet adjustable or selectable) load on the head 22, other arrangements may also be employed. For example, the load could be exerted by springs acting under compression between the rear surface of the head 22 and structure fixed to the deck 40, such springs being arranged in known manner to enable variation in their degree of compression for adjusting the magnitude of the exerted load.

Stated more generally, the purpose of the loadexerting means is to exert, on the applied liquid coating layer between the coating head 22 and the strip surface 17, a load which is maintained essentially constant across the full width of the strip and throughout the duration of a given coating operation, thereby to achieve the desired constant and uniform aperture of the metering orifice defined between edge 32 and the strip surface 17. In many instances, this objective is adequately achieved by simply operating the air cylinders 56 (in the illustrated embodiments of the invention) to exert a constant load of preselected magnitude on the head 22, balanced between the ends of the slot, for the duration of a given coating operation. In other cases, it may be preferable (for example) to vary the supplied load along the length of the trench, viz. to exert a load which (at any given point in time) may be nonuniform over the trench long dimension, fluctuating in accordance with nonuniformities in the advancing strip across the width of the strip, thereby to maintain a constant load on the applied paint layer across the strip width by compensating for these nonuniformities; and the coating head itself may be made somewhat flexible (in the direction transverse to the strip) to facilitate compensation for such nonuniformities, all within the broad contemplation of the invention.

It is to be understood that the invention is not limited to the features and embodiments hereinabove specifically set forth but may be carried out in other ways without departure from its spirit.

What is claimed is:

1. Apparatus for coating a major surface of an elongated strip article, comprising:

(a) a rigid coating head defining an elongated, open-sided slot and having an extended surface immediately adjacent the open side of the slot;

(b) means for supplying liquid coating material under pressure to the slot;

(c) means for supporting the head while permitting translational movement of the head relative to the supporting means in a direction perpendicular to the long dimension of the slot;

(d) means for continuously longitudinally advancing a strip article successively past the slot open side and the extended surface of the head in a direction transverse to the long dimension of the slot while maintaining a major surface of the article in facing proximate relation to the slot so as to constitute a moving wall substantially closing said open side, such that during operation with the article advancing past the slot and liquid coating material supplied to the slot, the last-mentioned article major surface drags a layer of the coating material from the slot, said advancing means supporting the strip, opposite the slot, at a fixed distance from the head-supporting means; and (e) mean, acting between the head-supporting means and the head, for continuously exerting a load on the head to urge the head toward the last-mentioned article major surface such that, during operation as aforesaid, said head is pressed by said load-exerting means against the deposited layer of coating material to maintain said layer at a predetermined constant thickness while said layer alone holds the head entirely away from contact with the last-mentioned article major surface.

2. Apparatus as defined in claim 1, wherein said load-exerting means is adjustable to vary the magnitude of said load.

3. Apparatus as defined in claim 1, wherein said load-exerting means comprises at least one air cylinder.

4. Apparatus as defined in claim 3, wherein said load-exerting means comprises a plurality of air cylinders acting on said head at spaced locations along the length of the slot.

5. Apparatus as defined in claim 1, wherein said advancing means includes a roll having an axis parallel to the long dimension of the slot and fixed in relation to the head-supporting means, said roll further having a cylindrical surface positioned closely adjacent the slot open side; and wherein said extended surface of said head is shaped and positioned to approach progressively nearer to said cylindrical surface in the direction of advance of the article.

6. Apparatus as defined in claim 5, wherein said extended surface has an upstream extremity at said slot, and a downstream extremity which is between 5 and 150 microns closer to said roll surface than is said upstream extremity.

7. A method of coating a major surface of an elongated strip article, comprising:

(a) supplying liquid coating material under pressure to an elongated, open-sided slot defined in a rigid coating head having an extended surface immediately adjacent the open side of the slot, said head being supported for translational movement in a direction perpendicular to the long dimension of the slot, while (b) continuously longitudinally advancing a strip article successively past the slot open side and the extended surface of the head in a direction transverse to the long dimension of the slot with a major surface of the article maintained in facing proximate relation to the slot so as to constitute a moving wall substantially closing said open side, such that the last-mentioned article major surface drags a layer of the coating material from the slot, and while (c) continuously exerting a load on the head to urge the head toward the last-mentioned article major surface such that the head is pressed by the load-exerting means against the deposited layer of coating material and maintains said layer at a predetermined constant thickness while said layer alone holds the head entirely away from contact with the last-mentioned article major surface.

* * * * *